US010085606B2

(12) United States Patent
Williams

(10) Patent No.: US 10,085,606 B2
(45) Date of Patent: Oct. 2, 2018

(54) SYSTEMS AND APPARATUSES FOR COOLING A VACUUM DEVICE

(71) Applicant: EMERSON ELECTRIC CO., St. Louis, MO (US)

(72) Inventor: Matthew A. Williams, Bridgeton, MO (US)

(73) Assignee: Emerson Electric Co., St. Louis, MO (US)

( * ) Notice: Subject to any disclaimer, the term of this patent is extended or adjusted under 35 U.S.C. 154(b) by 315 days.

(21) Appl. No.: 14/224,522

(22) Filed: Mar. 25, 2014

(65) Prior Publication Data

US 2014/0299297 A1 Oct. 9, 2014

Related U.S. Application Data

(60) Provisional application No. 61/809,641, filed on Apr. 8, 2013.

(51) Int. Cl.
*A47L 9/22* (2006.01)
*A47L 5/36* (2006.01)

(52) U.S. Cl.
CPC .. *A47L 9/22* (2013.01); *A47L 5/36* (2013.01)

(58) Field of Classification Search
CPC .... A47L 9/2857; A47L 9/2894; A47L 9/2889; A47L 9/22; A47L 9/242; A47L 5/36; A47L 5/14
See application file for complete search history.

(56) References Cited

U.S. PATENT DOCUMENTS 3,936,282 A 2/1976 Asplund et al.
4,759,422 A 7/1988 Belley
4,851,017 A 7/1989 Erickson et al.
5,068,555 A 11/1991 Oberdorfer-Bogel
5,592,716 A 1/1997 Moren et al.
5,701,631 A 12/1997 Lindquist
5,737,798 A 4/1998 Moren et al.
6,003,200 A * 12/1999 Potts ..... A47L 7/0028 15/327.2
6,175,988 B1 1/2001 White et al.
6,481,050 B1 * 11/2002 Wilson ..... A47L 9/22 15/413
6,581,241 B2 6/2003 Shaver et al.
6,611,989 B2 9/2003 Oh et al.
6,807,709 B2 10/2004 Fernandez-Grandizo Martinez
(Continued)

*Primary Examiner* — Robert Scruggs
(74) *Attorney, Agent, or Firm* — Armstrong Teasdale LLP

(57) ABSTRACT

Applicants have created vacuum systems and apparatuses for cooling a vacuum device. The apparatus can include a cooling device adapted to couple with a vacuum device, at least one cooling device air inlet, and a cooling device outlet. The air flows from the air inlets to the air outlet and combines with air disposed within the vacuum device. The system can include the cooling device, a vacuum housing, and a vacuum interface such that air flowing from the air inlets to the outlet flows from the vacuum interface to the vacuum housing biased with a negative pressure area. As a result, the air originating from the air inlets cools the air disposed within the vacuum housing upon mixing and the vacuum device cools, thus increasing the vacuum device's performance. Furthermore, heat transfer from the vacuum device to an operator reduces, thus improving the productivity and comfort of the operator.

32 Claims, 4 Drawing Sheets

(56) References Cited

U.S. PATENT DOCUMENTS

| | | | | |
|---|---|---|---|---|
| 7,120,965 | B2 | 10/2006 | Hisano et al. | |
| 7,353,565 | B2 | 4/2008 | Hisano et al. | |
| 7,690,485 | B2 | 4/2010 | Cho et al. | |
| 8,533,906 | B2 | 9/2013 | Liu | |
| 9,486,120 | B2 * | 11/2016 | Day | A47L 5/24 |
| 2004/0103493 | A1 * | 6/2004 | Moore | A47L 5/365 15/339 |
| 2004/0216266 | A1 * | 11/2004 | Conrad | A47L 5/28 15/412 |
| 2006/0005346 | A1 * | 1/2006 | Rupp | A47L 5/36 15/327.5 |
| 2009/0307865 | A1 * | 12/2009 | Williamson | A47L 5/225 15/344 |

* cited by examiner

SYSTEMS AND APPARATUSES FOR COOLING A VACUUM DEVICE

CROSS REFERENCE TO RELATED APPLICATIONS

The present application claims priority to U.S. Provisional Patent Application Ser. No. 61/809,641, filed Apr. 9, 2013, the contents which are incorporated herein by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to cooling a vacuum device. More specifically, the inventions described relate to vacuum radiator adapted to reduce the operating temperature of a vacuum device and further reduce the heat transfer from the vacuum device to an operator.

Description of the Related Art

The inventions disclosed and taught herein are directed to improved systems and apparatuses for cooling a vacuum device. Although these inventions can be used in numerous applications, the inventions will be disclosed in only a few of many applications for illustrative purposes.

Portable vacuum cleaners, such as ones mounted to a backpack or other harness-type support, are commonly used across a variety of applications and environments. These vacuum cleaners are a convenient alternative to traditional vacuum cleaners because of their increased mobility and portability. For example, backpack-style vacuum cleaners are often used in commercial environments, such as office buildings, because they allow the operator to quickly move from room to room with minimal interruption. Furthermore, backpack-style vacuum cleaners can be used in cramped or crowded environments that may otherwise be difficult or impossible for traditional style vacuum cleaners to reach, such as on buses, trains, and in subways.

Despite the advantages discussed above, mounted-style vacuum cleaners can have several drawbacks as well. For example, these vacuum cleaners can become uncomfortable during an extended use due to convective or radiant heat transferred from the user to the vacuum cleaner. Moreover, the excess heat generated during the vacuum cleaner's operation can decrease its overall efficiency. Finally, vacuum cleaners operating at high temperatures require materials that can withstand the excess heat generated during its operation. Typically, the cost of materials graded for these higher temperatures are more costly than materials with a lower temperature rating and, therefore, excess heat can contribute to the overall cost to manufacture the vacuum cleaner.

What is required, therefore, is a solution that provides a mounted-style vacuum device that is capable of reducing the overall heat generated during its use. As a result, this heat reduction can increase the vacuum's efficiency, decrease the overall cost of manufacturing, and improve the heat transfer to the vacuum's operators in order to improve their overall comfort when operating the vacuum device.

Accordingly, the inventions disclosed and taught herein are directed to systems and apparatuses for cooling a vacuum device that overcomes the problems as set forth above.

BRIEF SUMMARY OF THE INVENTION

The inventions disclosed and taught herein are directed to vacuum systems and apparatuses for cooling a vacuum device. The objects described above and other advantages and features of the inventions are incorporated in the application as set forth herein, and the associated appendices and drawings.

Applicants have created vacuum systems and apparatuses for cooling a vacuum device. The apparatus can include a cooling device adapted to couple with a vacuum device, at least one cooling device air inlet, and a cooling device outlet. The air flows from the air inlets to the air outlet and combines with air disposed within the vacuum device. The system can include the cooling device, a vacuum housing, and a vacuum interface such that air flowing from the air inlet to the outlet flows from the vacuum interface to the vacuum housing biased with a negative pressure area. As a result, the air originating from the air inlets cools the air disposed within the vacuum housing upon mixing and the vacuum device cools, thus increasing the vacuum device's performance. Furthermore, heat transfer from the vacuum device to an operator reduces, thus improving the productivity and comfort of the operator.

The apparatus for cooling a vacuum device can include a cooling device that can be adapted to couple with the vacuum device, at least one cooling device air inlet, and a cooling device air outlet. The air flowing from the at least one air inlet to the air outlet can be adapted to combine with air disposed within the vacuum device. Moreover, the air flowing from the at least one air inlet to the air outlet can originate from a location external to the vacuum device through the at least one air inlet. The air inlets can be disposed on, within, or formed as part of, the external surface of the cooling device. The air disposed within the vacuum device can be disposed within an area of negative pressure that can originate from air drawn through an appliance of the vacuum device.

The system for cooling a vacuum device can include a vacuum housing, a cooling device that can include at least one cooling device air inlet, and a cooling device air outlet. The air flowing from the at least one air inlet to the air outlet can be adapted to combine with air disposed within the vacuum housing that can include an area of negative pressure for facilitating a flow of air from the cooling device through the vacuum interface and into the vacuum housing.

The vacuum interface can be interposed between the cooling device and vacuum housing such that air flowing from the at least one air inlet to the air outlet can be adapted to flow from the vacuum interface to the vacuum housing. This air flow can originate from a location external to the vacuum device through the at least one air inlet. Further, the system can include an external surface in which the at least one air inlets can be disposed on, within, or formed as part of, the external surface of the cooling device. Further, the air disposed within the vacuum housing can originate from air drawn through an appliance of the vacuum device.

Still further, the system can include a seal that is adapted to couple the cooling device to an exhaust housing. The seal can include a gasket that is adapted to form an air-tight seal between the cooling device and the exhaust housing. The system can include a cover that is adapted to couple to the exhaust housing with the aid of one or more fasteners, a filter that is adapted to be coupled to the exhaust housing, and a motor inlet, wherein an air flow within the vacuum device can flow from the vacuum housing through the motor inlet and through the exhaust housing (such as through the exhaust housing inlet) to an exhaust housing outlet.

Finally, the system can include a baffle that can be adapted to direct exhaust air flowing from the vacuum device to a location away from an operator and a harness coupled to the vacuum device and adapted to be worn by an operator. The cooling device can be adapted to be positioned relative to the operator in order to reduce the heat transfer from the vacuum device to the operator.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1B:
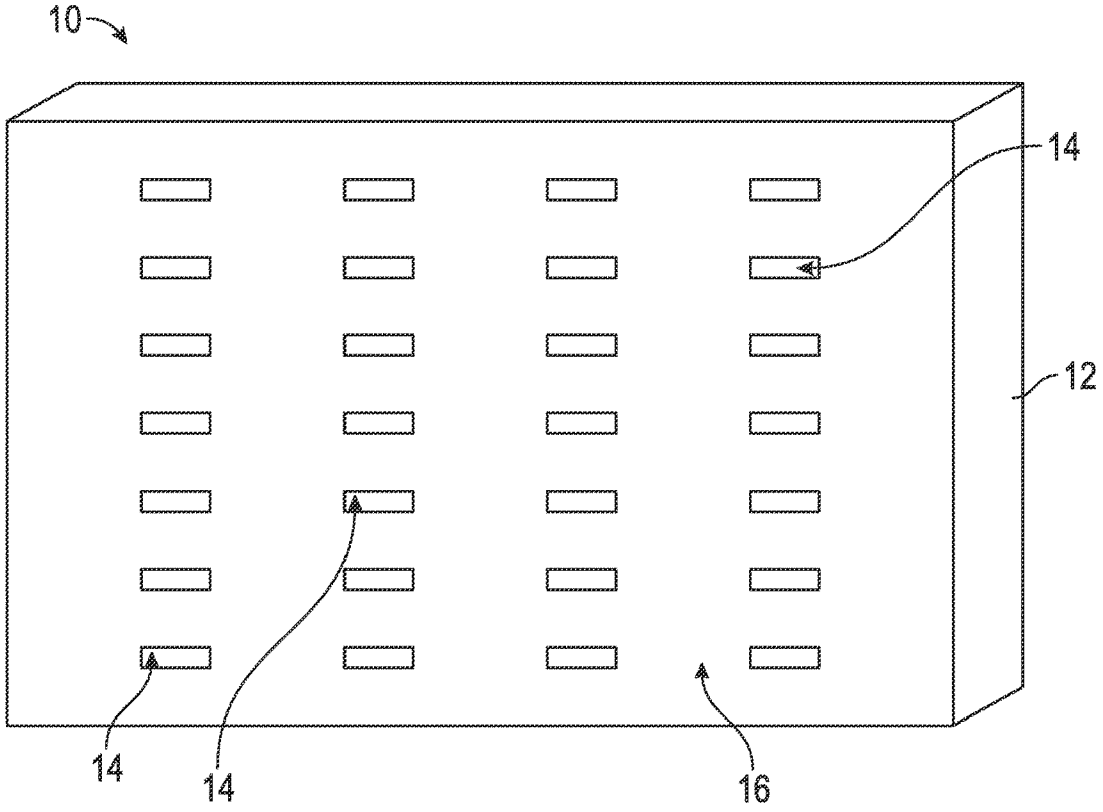
FIG. 1B illustrates a front isometric view of the first embodiment of the apparatus for cooling a vacuum device illustrated in FIG. 1A.

While the inventions disclosed herein are susceptible to various modifications and alternative forms, only a few specific embodiments have been shown by way of example in the drawings and are described in detail below. The Figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION OF THE INVENTION

The Figures described above and the written description of specific structures and functions below are not presented to limit the scope of what Applicant has invented or the scope of the appended claims. Rather, the Figures and written description are provided to teach any person skilled in the art to make and use the invention for which patent protection is sought.

Those skilled in the art will appreciate that not all features of a commercial embodiment of the invention are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. The coupling can occur in any direction, including rotationally.

Applicants have created vacuum systems and apparatuses for cooling a vacuum device. The apparatus can include a cooling device adapted to couple with a vacuum device, at least one cooling device air inlet, and a cooling device outlet. The air flows from the air inlets to the air outlet and combines with air disposed within the vacuum device. The system can include the cooling device, a vacuum housing, and a vacuum interface such that air flowing from the air inlet to the outlet flows from the vacuum interface to the vacuum housing biased with a negative pressure area. As a result, the air originating from the air inlets cools the air disposed within the vacuum housing upon mixing and the vacuum device cools, thus increasing the vacuum device's performance. Furthermore, heat transfer from the vacuum device to an operator reduces, thus improving the productivity and comfort of the operator.

Figure 1A:
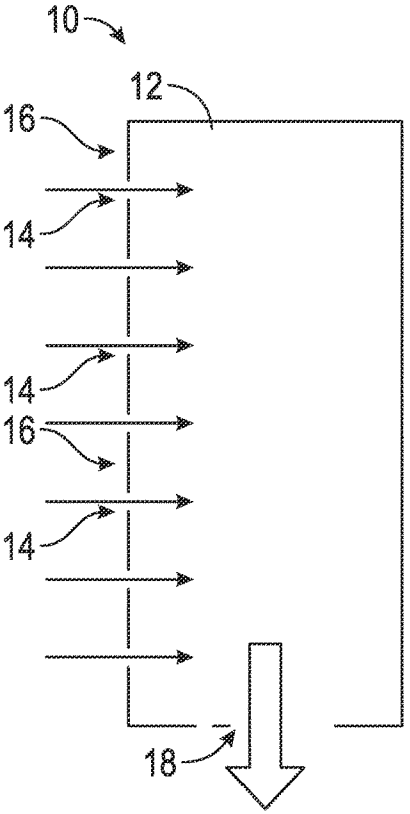
FIG. 1A illustrates a side view of a first embodiment an apparatus for cooling a vacuum device.

Referring specifically to the figures, FIG. 1A illustrates a side view of a first embodiment an apparatus for cooling a vacuum device. FIG. 1B illustrates a front isometric view of the first embodiment of the apparatus for cooling a vacuum device illustrated in FIG. 1A. These figures will be described in conjunction with one another.

The apparatus 10 can include a cooling device 12—that can be adapted to couple with the vacuum device 101 (e.g., FIG. 3)—at least one cooling device air inlet 14, and a cooling device air outlet 18. The air flowing from the at least one air inlet 14 to the air outlet 18 can be adapted to combine with air disposed within the vacuum device 101 (e.g., FIG. 3). Moreover, the air flowing from the at least one air inlet 14 to the air outlet 18 can originate from a location external to the vacuum device 101 (e.g., FIG. 3) through the at least one air inlet 14. The air inlets 14 can be disposed on, within, or formed as part of, the external surface 16 of the cooling device 12. The air disposed within the vacuum device 101 (e.g., FIG. 3) can be disposed within an area of negative pressure that can originate from air drawn through an appliance 208 (e.g., FIG. 4) of the vacuum device 101 (e.g., FIG. 3).

The cooling device 12 can include a cover, plate, lid, mount, or other structure for drawing air, or other liquids or gases, from an external surface 16 of cooling device 12 to an internal surface and/or portion of the cooling device 12. For example, cooling device 12 can include a radiator that includes one or more air inlets 14 for allowing air to pass through. Air inlets 14 can include perforations, holes, slots, punches, punctures, slits, orifices, cuts, bores, or the like for allowing air to pass there through. The air inlets 14 can be varying sizes and shapes, such as circular, elliptical, square, rectangular, etc., and the one or more air inlets 14 can be disposed either uniformly across cooling device 12, or randomly dispersed among different locations of cooling device 12.

Figure 3:
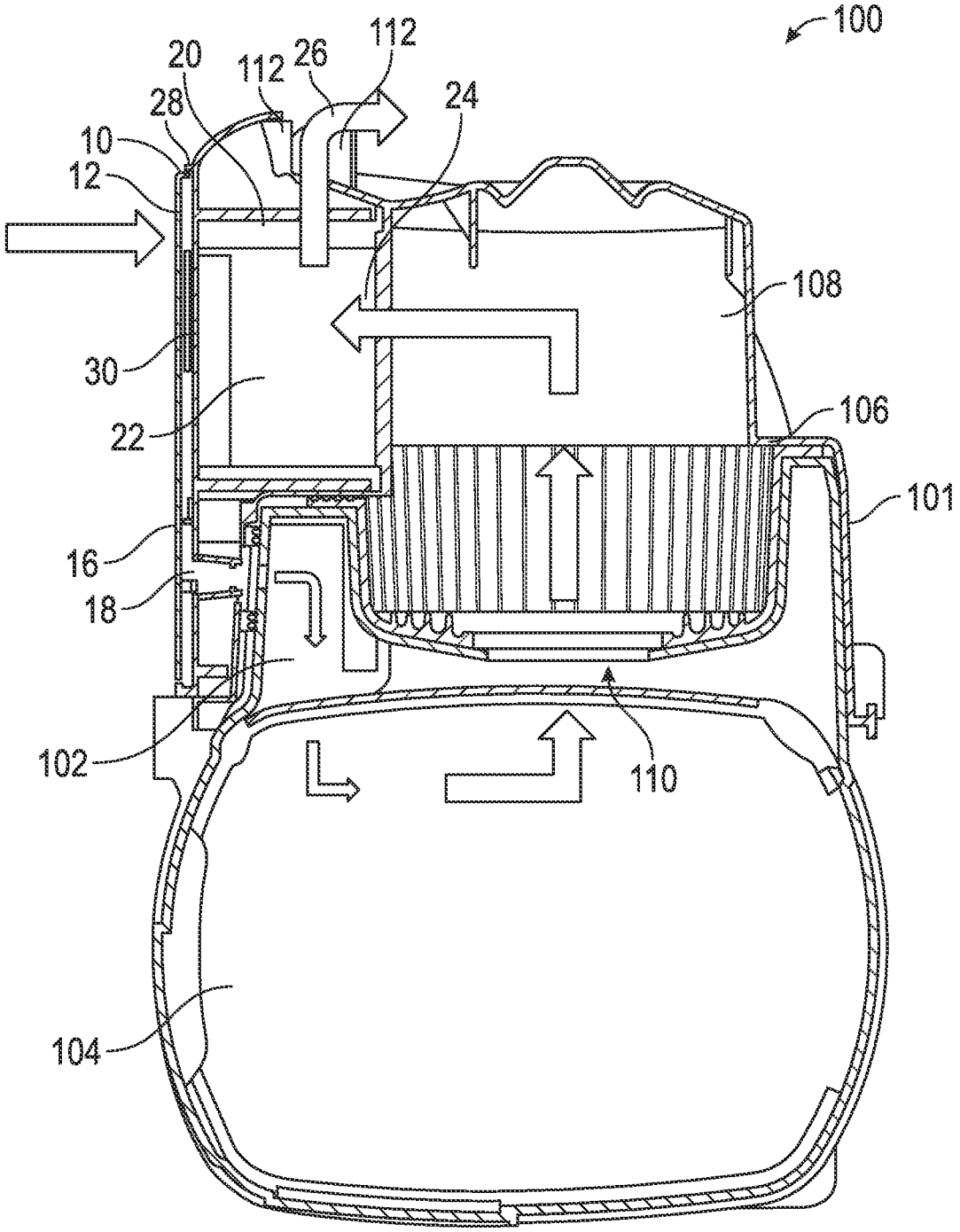
FIG. 3 illustrates a side view of a first embodiment of a system for cooling a vacuum device.

In an exemplary and non-limiting illustrative embodiment, cooling device 12 can include can include a cover that includes a plurality of air inlets 14 embodied as fins, pleats, folds, or the like. The cooling device 12 can further be adapted to couple to a portion of vacuum device 101 (e.g., FIG. 3). In this configuration, the cooling device's air inlet's 14 can be configured to allow air to pass through external surface 16 of cooling device 12 to draw cool, ambient air from an area external to the vacuum device 101 (e.g., FIG. 3) to a portion internal such as, for example, the vacuum housing 104 (e.g., as illustrated in FIG. 3) and discussed in greater detail below.

Figure 2A:
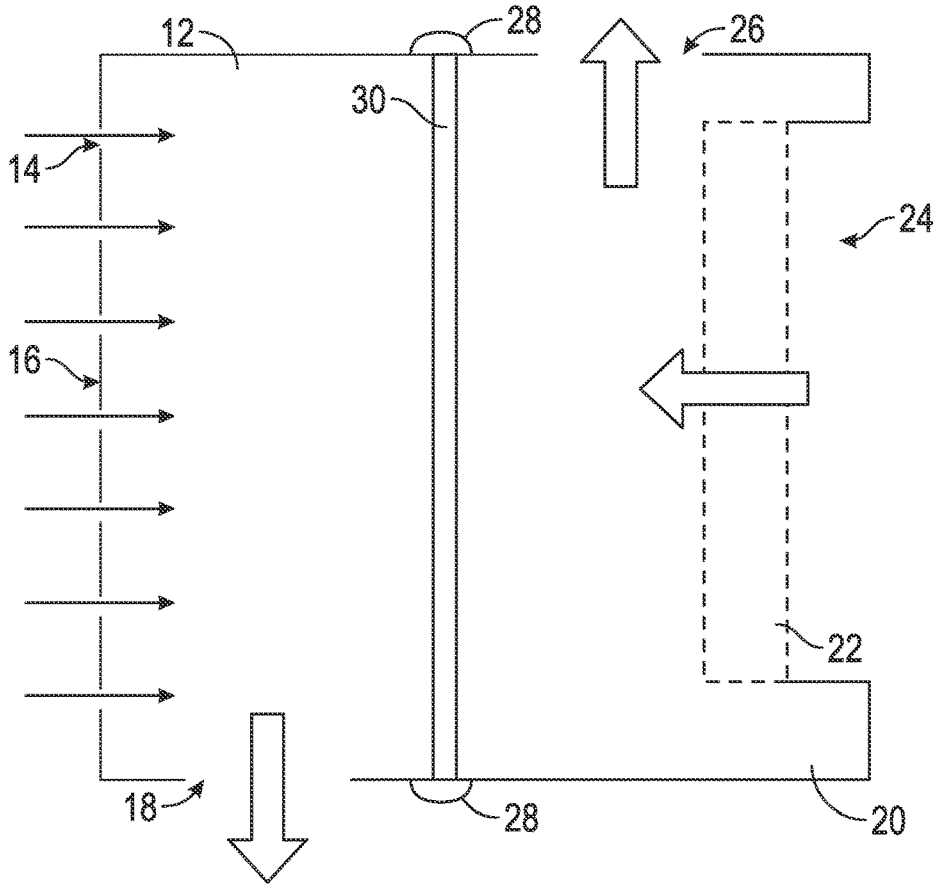
FIG. 2A illustrates a side view of the first embodiment of the apparatus for cooling a vacuum devices as illustrated in FIG. 1A including an illustration of several additional elements described in the present disclosure.
Figure 2B:
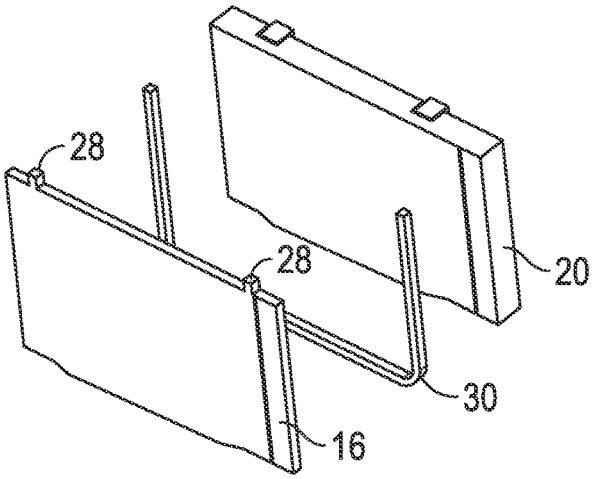
FIG. 2B illustrates an exploded isometric view of the apparatus for cooling a vacuum device illustrated in FIG. 2A including an illustration of several additional elements described in the present disclosure.

FIG. 2A illustrates a side view of the first embodiment of the apparatus for cooling a vacuum devices as illustrated in FIG. 1A including an illustration of several additional elements described in the present disclosure. FIG. 2B illustrates an exploded isometric view of the apparatus for cooling a vacuum device illustrated in FIG. 2A including an illustration of several additional elements described in the present disclosure. FIG. 3 illustrates a side view of a first embodiment of a system for cooling a vacuum device. These figures will be described in conjunction with one another.

The system 100 for cooling a vacuum device 101 can include a vacuum housing 104, a cooling device 12 that can include at least one cooling device air inlet 14, and a cooling device air outlet 18. The air flowing from the at least one air inlet 14 to the air outlet 18 can be adapted to combine with air disposed within the vacuum housing 104 that can include an area of negative pressure for facilitating a flow of air from the cooling device 12 through the vacuum interface 102 and into the vacuum housing 104.

Figure 4:
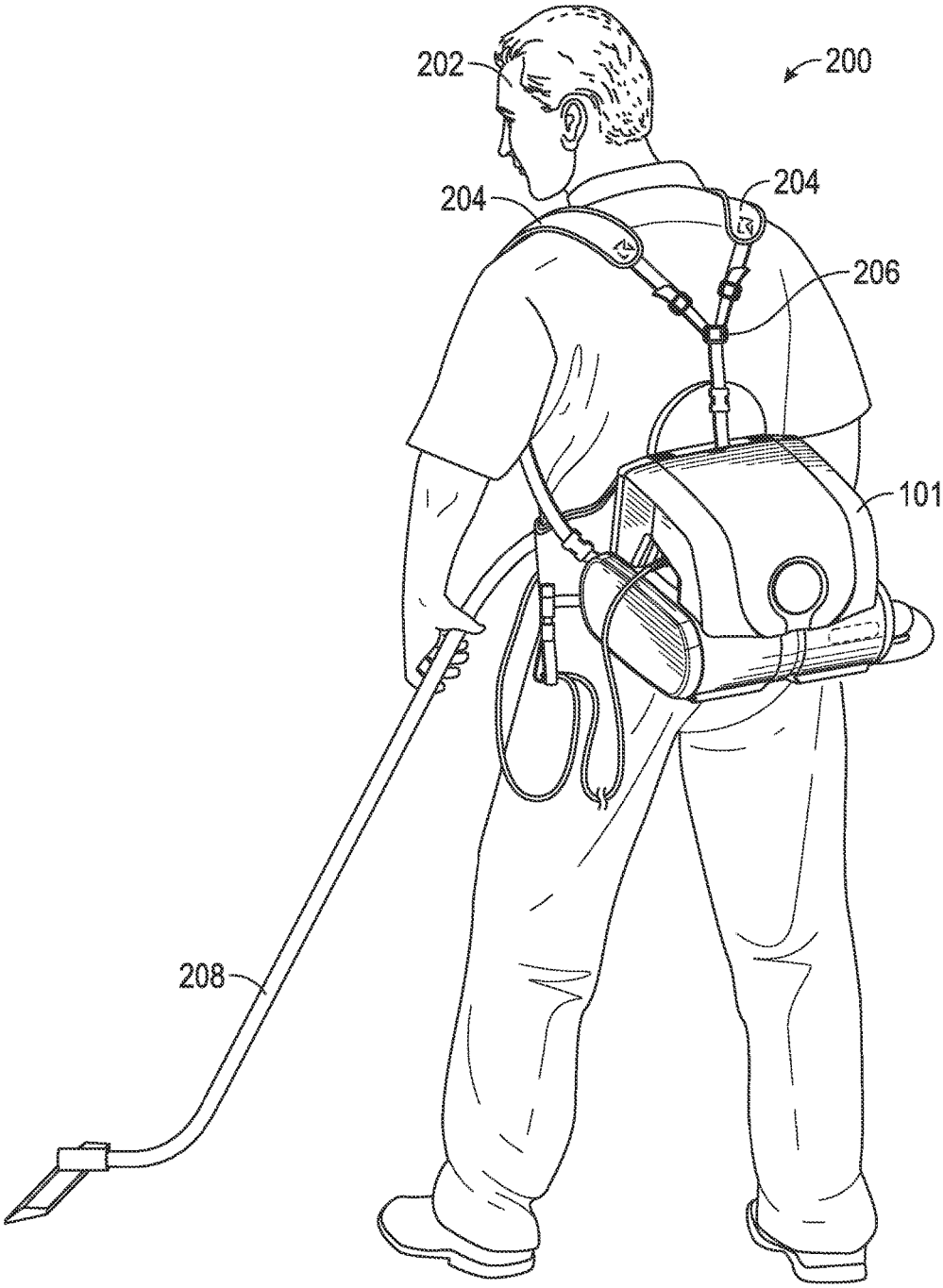
FIG. 4 illustrates an environmental view of the first embodiment of a system for cooling a vacuum device illustrated in FIG. 3.

The vacuum interface 102 can be interposed between the cooling device 12 and vacuum housing 104 such that air flowing from the at least one air inlet 14 to the air outlet 18 can be adapted to flow from the vacuum interface 102 to the vacuum housing 104. This air flow can originate from a location external to the vacuum device 101 (such as a portion located outside the external surface 16 of cooling device 12) through the at least one air inlet 14. Further, the system 100 can include an external surface 16 in which the at least one air inlets 14 can be disposed on, within, or formed as part of, the external surface 16 of the cooling device 12. Further, the air disposed within the vacuum housing 104 can originate from air drawn through an appliance 208 (as shown in FIG. 4) of the vacuum device 101. The flow of air through vacuum device 101 is described in greater detail below with specific reference to FIG. 3.

When the vacuum device 101 is switched to its "on" position, the motor 108 is energized, which in turn, rotates a blower wheel (not shown). The rotation of the blower wheel (not shown) causes a vacuum within the vacuum device 101. More specifically, the blower wheel's (not shown) rotation creates an area of negative pressure within vacuum housing 104 due to the suction created by the vacuum device 101. Although not shown in the figures, a vacuum housing inlet (not shown) can be coupled to the vacuum housing 104 for receiving air, debris, or other media, or the like originating from the surfaces cleaned by the vacuum device 101.

The vacuum created within the vacuum housing 104 creates further suction which, in turn, can result in ambient air being drawn into the vacuum device 101 through an external surface 16 of the cooling device 12. For example, the negative pressure zone created in the vacuum housing 104 can force cool, ambient air through the one or more cooling device air inlets 14 (as shown in FIG. 1A-1B) where the air can flow through cooling device 12 to cooling device air outlet 18. Cooling device air outlet 18 can include one or more perforations, holes, slots, punches, punctures, slits, orifices, cuts, bores, or the like for allowing air to pass there through towards the vacuum housing 104. For example, cooling device air outlet 18 can include a conduit for providing fluid communication between cooling device 18 and vacuum interface 102, vacuum housing 104, or both.

Vacuum housing 104 can further include a suction tap (not shown). This tap can include a conduit, for example, a hose, tubing, or any other type of conduit that is either flexible or rigid. Alternatively, suction tap (not shown) can include a port, or other inlet for allowing air flowing from one or more of the cooling device 12, cooling device air outlet 18, and/or vacuum interface 102, to the vacuum housing 104. Vacuum interface 102 can include any chamber, housing, enclosure, capsule, container, or the like for providing fluid communication for air, or other gases, liquids, or like the like between the cooling device 12 and the vacuum housing 104. Alternatively, vacuum interface 102 can include the interface between the cooling device air outlet 18 and the vacuum housing 104. In this example, vacuum interface 102 can be the boundary between the cooling device air outlet 18 and the vacuum housing 104 without the need for a separate chamber, housing, or the like to be interposed between cooling device air outlet 18 and the vacuum housing 104.

As the air is drawn through the vacuum interface 102 and into vacuum housing 104, it can combine with the air drawn through a vacuum housing inlet (not shown). Because the air drawn through the cooling device is cooler than the air drawn through the vacuum housing inlet (not shown), as the air combines, it cools before continuing to flow through the motor housing 106, thus cooling the motor 108.

For example, as shown in Table 1 below, a comparison of the thermal characteristics of a commercially available backpack-style vacuum with and without the cooling device was performed across multiple time intervals. The test performed illustrated a significant improvement in the operating temperatures of the vacuum that included cooling device 12.

TABLE 1

| TIME | TEMP (° C.)--with cooling device 12 | | | | | | TEMP (° C.)--without cooling device 12 | | | | | |
|---|---|---|---|---|---|---|---|---|---|---|---|---|
| MM:SS | 33 | 34 | 35 | 36 | 37 | 38 | 33 | 34 | 35 | 36 | 37 | 38 |
| 00:10.0 | 29 | 32 | 29 | 29 | 34 | 35 | 58 | 55 | 57 | 59 | 55 | 54 |
| 00:20.0 | 29 | 32 | 29 | 29 | 34 | 35 | 58 | 55 | 57 | 59 | 55 | 54 |
| 00:30.0 | 29 | 31 | 29 | 29 | 34 | 35 | 58 | 55 | 57 | 59 | 55 | 54 |
| 00:40.0 | 28 | 31 | 29 | 29 | 34 | 35 | 58 | 55 | 58 | 59 | 55 | 54 |
| 00:50.0 | 29 | 31 | 29 | 29 | 34 | 35 | 58 | 55 | 57 | 59 | 55 | 54 |
| 01:00.0 | 29 | 31 | 29 | 29 | 34 | 35 | 58 | 55 | 58 | 59 | 55 | 54 |
| 06:00.0 | 29 | 31 | 29 | 29 | 34 | 35 | 57 | 54 | 56 | 58 | 54 | 53 |
| 11:00.0 | 29 | 32 | 29 | 29 | 34 | 35 | 57 | 55 | 56 | 58 | 54 | 54 |
| 16:00.0 | 28 | 31 | 29 | 28 | 34 | 35 | 61 | 59 | 61 | 63 | 58 | 57 |
| 21:00.0 | 29 | 32 | 29 | 29 | 35 | 35 | 60 | 59 | 61 | 63 | 59 | 57 |
| 26:00.0 | 30 | 32 | 29 | 29 | 34 | 35 | 60 | 59 | 60 | 62 | 58 | 57 |
| 31:00.0 | 29 | 31 | 29 | 29 | 34 | 35 | 59 | 59 | 59 | 61 | 59 | 57 |
| 36:00.0 | 29 | 32 | 29 | 29 | 35 | 35 | 59 | 57 | 59 | 61 | 57 | 56 |
| 41:00.0 | 29 | 31 | 29 | 29 | 34 | 35 | 59 | 57 | 59 | 60 | 56 | 56 |
| 46:00.0 | 30 | 32 | 30 | 30 | 34 | 35 | 58 | 57 | 59 | 60 | 57 | 56 |
| 51:00.0 | 28 | 31 | 29 | 28 | 33 | 35 | 58 | 57 | 59 | 60 | 57 | 55 |
| 56:00.0 | 28 | 31 | 29 | 28 | 34 | 35 | 59 | 57 | 59 | 60 | 57 | 55 |

As shown in Table 2 below, the average improvement of the device with cooling unit 12 to the one without was 36%-52%.

TABLE 2

| TIME MM:SS | TEMP (° C.) 33 | 34 | 35 | 36 | 37 | 38 |
|---|---|---|---|---|---|---|
| | % Improvement | | | | | |
| 00:10.0 | 50% | 42% | 49% | 51% | 38% | 35% |
| 00:20.0 | 50% | 42% | 49% | 51% | 38% | 35% |
| 00:30.0 | 50% | 44% | 49% | 51% | 38% | 35% |
| 00:40.0 | 52% | 44% | 50% | 51% | 38% | 35% |
| 00:50.0 | 50% | 44% | 49% | 51% | 38% | 35% |
| 01:00.0 | 50% | 44% | 50% | 51% | 38% | 35% |
| 06:00.0 | 49% | 43% | 48% | 50% | 37% | 34% |
| 11:00.0 | 49% | 42% | 48% | 50% | 35% | 35% |
| 16:00.0 | 54% | 47% | 52% | 56% | 41% | 39% |
| 21:00.0 | 52% | 46% | 52% | 54% | 41% | 39% |
| 26:00.0 | 50% | 46% | 52% | 53% | 41% | 39% |
| 31:00.0 | 51% | 47% | 51% | 52% | 42% | 39% |
| 36:00.0 | 51% | 44% | 51% | 52% | 39% | 38% |
| 41:00.0 | 51% | 46% | 51% | 52% | 39% | 38% |
| 46:00.0 | 48% | 44% | 49% | 50% | 40% | 38% |
| 51:00.0 | 52% | 46% | 51% | 53% | 42% | 36% |
| 56:00.0 | 53% | 46% | 51% | 53% | 40% | 36% |
| | 51% | 44% | 50% | 52% | 39% | 36% |
| | Average Improvement | | | | | |

Although not shown in the figures, further improvement in the thermal characteristics of the vacuum device 101 can be realized with an increase air flow through the cooling device air inlets 14 and/or by cooling the air flowing through cooling device 12 before, during, or after, it combines with air in vacuum housing 104. For example, a device, such as fan, impeller assembly, or the like (not shown) can be coupled with or disposed within cooling device 12 (or alternatively, another element of vacuum device 101) to create an additional or increased negative pressure zone within the vacuum device 101. This negative pressure area can further increase the amount of cool air drawn within the cooling device 12 thus reducing the overall temperature of the vacuum device's 101 motor 108 and/or external surface 16.

Other devices for increasing the amount of air drawn through the cooling device air inlets 14 can be employed as well. For example, a venturi, tube, conduit, or the like (not shown) can be coupled to or formed as part of the baffle 112, the exhaust housing 20, the exhaust housing outlet 26, and/or any other portion of vacuum 101 to allow the pressure created by the flow of exhaust to increase the fluid velocity of the ambient air to be drawn into cooling device 12. For example, with the addition of a venturi (not shown), the pressure drop across the venturi can be used to draw a greater volume of ambient air, flowing with an increased fluid velocity, thus further cooling the external surface 16 and motor 108 to further improve the cooling effect within vacuum 101.

Additionally, a cooling mechanism (not shown) can be disposed within or coupled to cooling device for reducing the temperature of the air either before, during, or after it passes through cooling device 12. For example, the temperature of the external surface 16 of the cooling device 12 can be regulated such that it is at a temperature that is lower than that of the ambient air. In this configuration, the temperature of the air flowing through cooling device air inlets 14 can drop, thus resulting in additional cooling of the combined air within the vacuum device 101.

Once the air is combined in vacuum housing 104, it can pass through to motor housing 106 through motor inlet 110. Motor housing 106 can include any chamber, housing, enclosure, capsule, container, or the like for providing fluid communication for air, or other gases, liquids, or like the like between the vacuum housing 104 and the exhaust housing 20. In one example, the motor housing 106 can include the motor 108 and the blower wheel (not shown). In another example, motor housing 106 can include one more of the motor 108 and the blower wheel (not shown) coupled to it, with or without one or more of those components disposed within the motor housing 106. In another example, the motor housing 106 can be an interface serving as a boundary between the vacuum housing 104 and the exhaust housing 20.

As the combined air flows through motor housing 106, it is drawn to the exhaust housing 20 through exhaust housing inlet 24 and into exhaust housing 20 through one or more filters 22. The one or more filters 22 can include a single filter, or one or more filter units (not shown). For example, a filter unit (not shown) can be releasably coupled to, or decoupled from, the filter unit cavities (not shown). In this configuration, the filter units (not shown) can easily be replaced or interchanged with another if necessary. In one embodiment, each of the filter units (not shown) can include interchangeable self-contained cartridges. Filters 22 can include any filter for filtering contaminates or other solid particulates from the air. For example, the filter 22 can include High-Efficiency Particulate Air (HEPA) filters.

As the combined air flow through filter 22, it can exit, through the exhaust housing outlet 26, as exhaust. Exhaust housing outlet 26 can be in fluid communication with one or more of the filters 22, the exhaust housing inlet 24, and the exhaust housing 20. Exhaust housing 20 can include any chamber, housing, enclosure, capsule, container, or the like for providing fluid communication for air, or other gases, liquids, or like the like between the motor housing 106 to an external portion of the vacuum device 101. For example, exhaust housing can house filter 22 as described above, or in the alternative, can be coupled with one or more filters 22. In another example, filter 22 can be disposed at a location such that filter 22 is not interposed between exhaust housing inlet 24 and exhaust housing outlet 26 (such as, for example, the filter 22 can disposed within, or coupled to, vacuum housing 104).

As the exhaust exits the exhaust housing outlet 26, the flow of the exhaust can be redirected through the use of a baffle 112. Baffle 112 can include any wall, panel, divider, insert, border, or the like suitable for deflecting, redirecting, or at least partially obstructing the flow of air, gas, any gaseous-like material. In an exemplary and non-limiting illustrative embodiment, baffle 112 can include a panel disposed on or near an external surface of vacuum device 101 such that it deflects the exhaust up and away from an operator 202 (as shown in FIG. 4). The baffle 112 can be employed to redirect the exhaust in directions other than up and away from the vacuum device 101 as well. By redirecting the exhaust, the vacuum device 101 can further reduce the amount of heat transfer to the operator 202 (as shown in FIG. 4) when operating the vacuum device 101 which, in an exemplary embodiments, can include any back-pack style portable vacuum, or in the alternative, any conventional, wet/dry, canister, handheld vacuum, etc.

Referring back to FIGS. 2A and 2B, portions of the vacuum device 101 (as shown in FIG. 3) can be coupled with the use of one or more fasteners 28. Fastener 28 can include any bracket, support, mount, coupler, fastener, screw, bolt, clip, adhesive, or the like for coupling the cooling device 12 to another portion the vacuum device 101. For example, as illustrated in FIG. 2A, fastener 28 can couple cooling device 12 to exhaust housing 20 so that cooling device 12 can be removed from, and reattached to, exhaust housing 20.

Although not depicted in the figures, fastener 28 can be used to couple and/or attach other portions of vacuum device 101 to one another as well. For example, one or more fasteners 28 can be used to couple exhaust housing 20 to motor 108, motor housing 106, etc. Other combinations are contemplated as well. Furthermore, similar or dissimilar fasteners 28 can be employed for coupling each component of vacuum device 101 to another (e.g., cooling device 102 can employ clips and exhaust housing can employ screws).

In addition to the fasteners 28, the system 100 can include a seal 30 that is adapted to couple the cooling device 12 to an exhaust housing 20. The seal 30 can include one or more gaskets, O-rings, sealants, adhesives, or other seals, or the like that are adapted to form an air-tight seal between the cooling device 12 and the exhaust housing 20. The system 100 can include a filter 22 that is adapted to be coupled to the exhaust housing 20 (although, alternatively, filter 22 can be coupled to one or more other components of vacuum device 101 as well), a motor 108 that can be disposed within motor housing 106, and a motor inlet 110, wherein an air flow within the vacuum device 101 can flow from the vacuum housing 104 through the motor inlet 110 and through the exhaust housing 20 (such as from exhaust housing inlet 24 to the exhaust housing outlet 26).

FIG. 4 illustrates an environmental view of the first embodiment of a system for cooling a vacuum device illustrated in FIG. 3. System 200 can include the system 100 as described in conjunction with FIG. 3 above. For example, system 200 can include the baffle 112 (as shown in FIG. 3) that can be adapted to direct exhaust air flowing from the vacuum device 101 to a location away from an operator 202, an appliance 208, and a harness 204—coupled to the vacuum device 101—that can further include one or more straps 206 for supporting the weight of the vacuum device 101. In this configuration, harness 204 and straps 206 can work in conjunction with one another so that they can be adapted to be worn by an operator 202. The cooling device 12 (as shown in FIG. 3) can be adapted to be positioned relative to the operator 202 in order to reduce the heat transfer from the vacuum device to the operator 202.

The harness 204 can include any strap, belt, looped band, brace, or any other device for fastening, securing, or supporting the weight of the vacuum device 101. For example, the harness 204 can include at least one shoulder strap that can be secured around one or more of the operator's 202 shoulders. Furthermore, the harness 204 can include a vest, harness, or any other close-fitting apparatus for supporting the weight of the vacuum device 101. The harness 204 can be coupled to the straps 206 that can include any strap, belt, band, brace, or any other device for further fastening, securing, or supporting the harness 204 to the vacuum device 101.

Both the harness 204 and the straps 206 can be made to be adjustable, such as for tightening or loosening the length of each of these elements to adjust for varying heights of the operator 202. Furthermore, vacuum appliance 208 can include crevice tools, brushes, squeegees, wands, or the like that can be used in conjunction with a hose (not shown), either through a friction-fit, or lock-fit configuration to quickly interchange the vacuum appliance 208 selected by an operator 202.

For purposes of clarity and understanding, one or more of these components may not be specifically described or shown while, nevertheless, being present in one or more embodiments of the invention, such as in a commercial embodiment, as will be readily understood by one of ordinary skill in the art.

Particular embodiments of the invention may be described below with reference to block diagrams and/or operational illustrations of methods. It will be understood that each block of the block diagrams and/or operational illustrations, and combinations of blocks in the block diagrams and/or operational illustrations, can be implemented by analog and/or digital hardware, and/or computer program instructions. Such computer program instructions may be provided to a processor of a general-purpose computer, special purpose computer, ASIC, and/or other programmable data processing system. The executed instructions may create structures and functions for implementing the actions specified in the block diagrams and/or operational illustrations.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Discussion of singular elements can include plural elements and vice-versa.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range or equivalent of the following claims.

What is claimed is:

1. An apparatus for cooling a backpack vacuum device having a surface held adjacent an operator by a harness, the apparatus comprising:

a cooling device, wherein the cooling device is adapted to be coupled with the vacuum device, the cooling device including:

an external surface facing the operator's back and positioned between the operator's back and the vacuum device;

at least one cooling device air inlet in the external surface facing the operator's back; and a cooling device air outlet spaced from the at least one cooling device air inlet, wherein air flowing from the at least one air inlet to the air outlet is adapted to combine with air disposed within the vacuum device, and wherein the air flowing from the at least one air inlet to the air outlet cools the external surface facing the operator's back in order to reduce the heat transfer from the vacuum device to the operator; and a baffle configured to direct exhaust air away from the operator.

2. The apparatus of claim 1, wherein the air flowing from the at least one air inlet to the air outlet originates from a location external to the vacuum device.

3. The apparatus of claim 1, wherein the air disposed within the vacuum device is disposed within an area of negative pressure.

4. The apparatus of claim 1, wherein the air disposed within the vacuum device originates from air drawn through an appliance of the vacuum device.

5. A system for cooling a backpack vacuum device having a surface held adjacent an operator by a harness, the system comprising:

a vacuum housing;

a cooling device comprising:

an external surface facing the operator's back and positioned between the operator's back and the vacuum device;

at least one cooling device air inlet in the external surface facing the operator's back; and a cooling device air outlet spaced from the at least one cooling device air inlet, wherein air flowing from the at least one air inlet to the air outlet combines with air disposed within the vacuum housing and wherein the air flowing from the at least one air inlet to the air outlet cools the external surface facing the operator's back in order to reduce the heat transfer from the vacuum device to the operator;

a vacuum interface, wherein air flowing from the at least one air inlet to the air outlet is adapted to flow from the vacuum interface to the vacuum housing; and a baffle configured to direct exhaust air flowing from the vacuum device away from the operator.

6. The system of claim 5, wherein the air flowing from the at least one air inlet to the air outlet originates from a location external to the vacuum device through the at least one air inlet.

7. The system of claim 5 wherein the air disposed within the vacuum housing is disposed within an area of negative pressure.

8. The system of claim 5 wherein the air disposed within the vacuum housing originates from air drawn through an appliance of the vacuum device.

9. The system of claim 5, wherein the vacuum interface is interposed between the cooling device and the vacuum housing.

10. The system of claim 9, wherein an area of negative pressure within the vacuum housing facilitates a flow of air from the cooling device through the vacuum interface and into the vacuum housing.

11. The system of claim 5 further comprising a seal, wherein the seal is adapted to couple the cooling device to an exhaust housing.

12. The system of claim 11, wherein the seal includes a gasket adapted to form an air-tight seal between the cooling device and the exhaust housing.

13. The system of claim 11, wherein the cooling device includes a cover, wherein the cover is adapted to couple to the exhaust housing with the aid of one or more fasteners.

14. The system of claim 11 further comprising a filter, wherein the filter is adapted to be coupled to the exhaust housing.

15. The system of claim 11 further comprising a motor inlet, wherein an air flow within the vacuum device flows from the vacuum housing through the motor inlet and through the exhaust housing to an exhaust housing outlet.

16. The system of claim 5 further comprising a harness, wherein the harness is coupled to the vacuum device and adapted to be worn by an operator.

17. An apparatus for cooling a backpack vacuum device having a surface held adjacent an operator by a harness, the apparatus comprising:

a cooling device, wherein the cooling device is adapted to be coupled with the vacuum device, the cooling device including:

an external surface facing the operator's back and positioned between the operator's back and the vacuum device;

at least one cooling device air inlet in the external surface facing the operator's back; and a cooling device air outlet spaced from the at least one cooling device air inlet, wherein air flowing from the at least one air inlet to the air outlet is adapted to combine with air disposed within the vacuum device, and wherein the air flowing from the at least one air inlet to the air outlet cools the external surface in order to reduce the heat transfer from the vacuum device to the operator; and a baffle configured to direct exhaust air away from the operator.

18. The apparatus of claim 17, wherein the air flowing from the at least one air inlet to the air outlet originates from a location external to the vacuum device.

19. The apparatus of claim 17, wherein the air disposed within the vacuum device is disposed within an area of negative pressure.

20. The apparatus of claim 17, wherein the air disposed within the vacuum device originates from air drawn through an appliance of the vacuum device.

21. The apparatus of claim 17 wherein the air disposed within the vacuum housing originates from air drawn through an appliance of the vacuum device.

22. A system for cooling a backpack vacuum device having a surface held adjacent an operator by a harness, the system comprising:

a vacuum housing;

a cooling device comprising:

an external surface facing the operator's back and positioned between the operator's back and the vacuum device;

at least one cooling device air inlet in the external surface facing the operator's back; and a cooling device air outlet spaced from the at least one cooling device air inlet, wherein air flowing from the at least one air inlet to the air outlet combines with air disposed within the vacuum housing and wherein the air flowing from the at least one air inlet to the air outlet cools the external surface in order to reduce the heat transfer from the vacuum device to the operator;

a vacuum interface, wherein air flowing from the at least one air inlet to the air outlet is adapted to flow from the vacuum interface to the vacuum housing; and a baffle configured to direct exhaust air flowing from the vacuum device away from the operator.

23. The system of claim 22, wherein the air flowing from the at least one air inlet to the air outlet originates from a location external to the vacuum device through the at least one air inlet.

24. The system of claim 22, wherein the air disposed within the vacuum housing is disposed within an area of negative pressure.

25. The system of claim 22, wherein the vacuum interface is interposed between the cooling device and the vacuum housing.

26. The system of claim 25, wherein an area of negative pressure within the vacuum housing facilitates a flow of air from the cooling device through the vacuum interface and into the vacuum housing.

27. The system of claim 22 further comprising a seal, wherein the seal is adapted to couple the cooling device to an exhaust housing.

28. The system of claim 27, wherein the seal includes a gasket adapted to form an air-tight seal between the cooling device and the exhaust housing.

29. The system of claim 27, wherein the cooling device includes a cover, wherein the cover is adapted to couple to the exhaust housing with the aid of one or more fasteners.

30. The system of claim 27 further comprising a filter, wherein the filter is adapted to be coupled to the exhaust housing.

31. The system of claim 27 further comprising a motor inlet, wherein an air flow within the vacuum device flows from the vacuum housing through the motor inlet and through the exhaust housing to an exhaust housing outlet.

32. The system of claim 22 further comprising a harness, wherein the harness is coupled to the vacuum device and adapted to be worn by an operator.

* * * * *